United States Patent [19]

Elsner et al.

[11] 4,291,190

[45] Sep. 22, 1981

[54] FLUID-COOLED HOLDER FOR AN ELECTRODE TIP

[75] Inventors: Emil Elsner; Rudolf Kasper, both of Baden-Baden, Fed. Rep. of Germany; William E. Schwabe, Middleburg Heights, Ohio

[73] Assignee: Korf & Fuchs Systemtechnik GmbH, Willstadt-Legel-shurst, Fed. Rep. of Germany

[21] Appl. No.: 84,144

[22] Filed: Oct. 12, 1979

[30] Foreign Application Priority Data

Oct. 18, 1978 [DE] Fed. Rep. of Germany ..... 2845367

[51] Int. Cl.[3] ..... H05B 7/06

[52] U.S. Cl. ..... 13/18 R

[58] Field of Search ..... 13/18 R, 18 A, 18 B, 13/18 C

[56] References Cited

U.S. PATENT DOCUMENTS 3,392,227 7/1968 Ostberg ..... 13/18 A X 4,121,042 10/1978 Prenn ..... 13/18 R 4,145,564 3/1979 Andrew ..... 13/18 A

FOREIGN PATENT DOCUMENTS 941383 4/1956 Fed. Rep. of Germany ..... 13/18

*Primary Examiner*—Roy N. Envall, Jr.

[57] ABSTRACT

A fluid-cooled holder for the tip of an electrode of an electric arc smelting furnace, having a cylindrical holding portion which can be secured to an electrode support arm, a metal cooling system which is secured to the holding portion and which carries a screw-threaded portion for screwing on the electrode tip, and also having a tubular heat screen which is disposed around the cooling system at a spacing and which comprises a metal tube (11, 11*a*) which is electrically insulated with respect to the current-carrying cooling system (3, 3*a*) and which can be sufficiently cooled, by way of a refractory substance (17, 17*a*) between the cooling system and the metal tube, for the temperature of the metal tube to be kept to a value below the softening temperature of the material of the metal tube, when the holder is used in an electric arc smelting furnace.

16 Claims, 6 Drawing Figures

FLUID-COOLED HOLDER FOR AN ELECTRODE TIP

The invention relates to a fluid-cooled holder for the tip of an electrode of an electric arc smelting furnace.

Fluid-cooled holders of this kind, which form the upper part of an electric arc electrode with a consumable or non-consumable electrode tip, are known for example from DOS No 15 65 207. So that the metal cooling system of the holder can be protected from radiant and convection heat of the electric arc and also from the gases in the electric arc smelting furnace, there is a tubular heat screen means comprising highly heat-resistant material such as a ceramic material, which is disposed around the cooling system at a spacing therefrom. In order to improve the mechanical strength of the ceramic enclosure, the ceramic enclosure may be provided with a wire insert.

When the electrode is used in an electric arc smelting furnace in which for example scrap is being melted down, it may happen, when the electrode is being extended into the furnace or also due to the scrap material collapsing during operation of the furnace, that the refractory protective layer around the conduit system of the holder suffers damage. When this occurs, the arc may flash over between the metal charge in the arc furnace and the fluid system which carries the electrical current for the electric arc electrode. In this case, the conduit system for the cooling fluid is also very quickly damaged, and the result may be water penetrating into the furnace, and explosions. Although an electrode with a wire insert in the ceramic heat screen means is protected from such phenomena to a somewhat better degree than an electrode without a wire insert, nonetheless it is also not possible in this case to exclude damage in regions of the electrode, and such damage has the above-indicated results.

The aim of the invention is a fluid-cooled holder of the above-indicated kind, for an electrode tip, which, while being of a surprisingly simple structure, provides not only the required thermal protection for the metal cooling system with respect to the atmosphere in the furnace, but also provides improved mechanical protection.

The invention is based on the discovery that a heat screen means comprising a metal tube which is electrically insulated with respect to the current-carrying cooling system can be sufficiently cooled, that is to say, can be kept at a temperature below the softening point, in particular at temperatures of less than 600° C., by way of a refractory substance between the cooling system and the metal tube, while maintaining the electrical insulation required. Thus, the heat screen means may be in the form of a steel case and thus is a very simple structural element which provides excellent mechanical protection.

Figure 1:
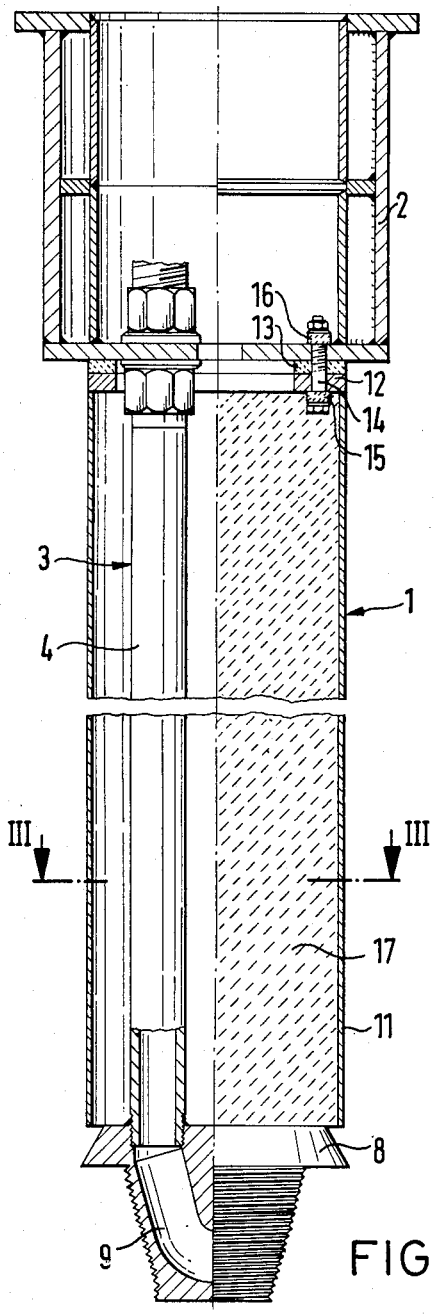
Figure 2:
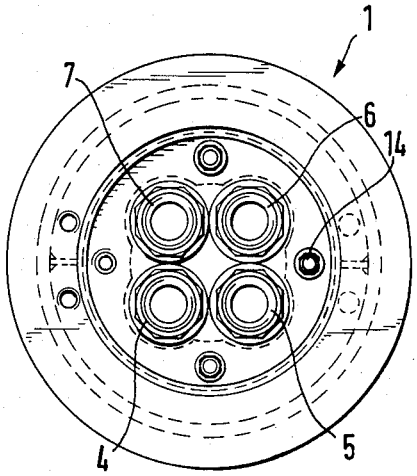
Figure 3:
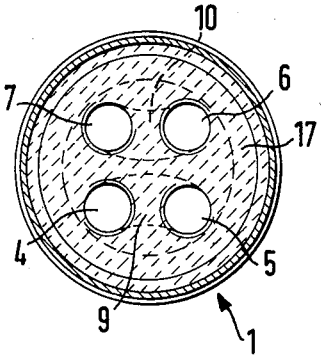
Figure 4:
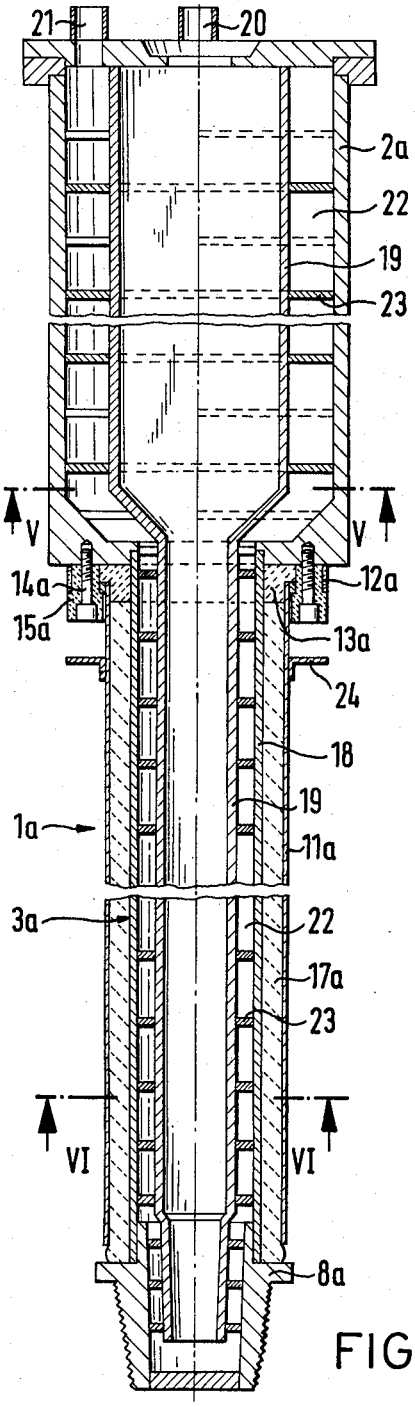
Figure 5:
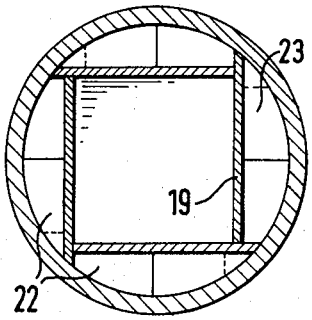
Figure 6:
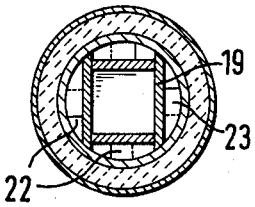

The invention is described in greater detail hereinafter by means of two embodiments with reference to six figures of drawings in which:

FIG. 1 shows a view in longitudinal section of a first embodiment of a holder according to the invention, FIG. 2 shows a plan view of the holder of FIG. 1, FIG. 3 shows a view in cross-section taken along line III—III of the holder of FIG. 1, FIG. 4 shows a view in longitudinal section of a second embodiment of a holder according to the invention, FIG. 5 shows a view in cross-section taken along line V—V of the holder of FIG. 4, and FIG. 6 shows a view in cross-section taken along line VI—VI of the holder of FIG. 4.

The fluid-cooled holder 1 shown in FIGS. 1 to 3, for the tip (not shown) of an electrode of an electric arc smelting furnace includes a cylindrical holding portion 2 which can be secured to the electrode support arm and which in this case has a separate water-cooling means, and a metal cooling system 3 which is secured to the holding portion 2 and which carries the electrode current. In the present case, the cooling system 3 comprises four flow pipes 4 to 7 which at the lower end carry a screw-threaded portion 8 which is in the form of a nipple, for screwing on the electrode tip. The nipple 8 which preferably comprises copper includes two passages 9 and 10. The pipes 4 and 5 are interconnected by means of the passage 9 while the pipes 6 and 7 are interconnected by the passage 10. In this arrangement therefore, in each of the two pairs of pipes 4, 5 and 6, 7 respectively, one pipe serves as a feed duct for the cooling fluid and the other pipe serves as the return duct for the cooling fluid.

The metal cooling system 3 is surrounded by a metal tube 11, at a spacing therefrom. The metal tube 11 is electrically insulated with respect to the current-carrying cooling system 3. For this purpose, a flange 12 which is welded to the metal tube 11 is secured to the bottom of the cup-shaped holder 2, by way of a spacer ring 13 of heat-resistant insulating material. The form of fixing selected is a screw connection. In the present embodiment, there are four pairs 14 of nuts and bolts comprising non-magnetic steel, which are insulated with respect to the metal components by spacer members 15 and 16 of heat-resistant insulating material, shrink pertinax being selected in the present case. The nuts and bolts could also comprise an insulating material. The flow pipes of the cooling system 3 are of copper. If the metal tube 11 is not also utilised for carrying the electrode tip, it may be desirable for the flow pipes to comprise a different material which has good electrical conductivity and which has a higher level of strength.

Disposed between the metal tube 11 and the cooling system 3 is a refractory substance 17 by way of which the metal tube is cooled to the above-indicated permissible upper limit. At the operating temperatures, the refractory material should ensure on the one hand sufficient heat transfer between the cooling system 3 and the metal tube 11 to be cooled, but on the other hand should also ensure good electrical insulation between the metal tube 11 and the parts of the cooling system which carry the electrical current. Good results have been achieved, with regard to this requirement, by using a refractory material comprising magnesium oxide sand or an aluminium oxide tamping material. When using a granular material, a tamping material or a castable material as the refractory substance, manufacture of the electrode is extraordinarily simple, as can be readily seen. After the metal tube 11 has been secured to the holding portion 2, it is only necessary for the refractory material to be filled into, tamped into or cast into the intermediate space between the cooling system and the metal tube.

A soft carbon steel can be used as the material for the metal tube 11, for economy reasons. However, non-magnetic, scaling-resistant steels or possibly other highly heat-resistant non-magnetic metals are more advantageous.

Like the first embodiment described above, the second embodiment, namely the fluid-cooled holder 1*a* shown in FIGS. 4 to 6, also includes a cylindrical holding portion 2*a* which can be secured to the electrode support arm. The holding portion 2*a*, together with the tube 18 which is preferably made from copper, and the screw-threaded portion 8*a* which is in the form of a nipple, forms the conductor and cooling system 3*a*, which carries the electrode current and the cooling fluid.

For the purpose of positively guiding the cooling fluid, a welded or cast metal member 19 is fitted into and pushed into the cooling system 3*a* which carries the electrode current and the cooling fluid. References 20 and 21 denote a water feed and a water discharge respectively. Alternately disposed baffle plates 23 which in the present case are horizontal are provided in the four outer vertical passages 22. The baffle plates 23 are fixedly connected to or are made integrally with the member 19.

Below the holding portion 2*a*, the cooling system which carries the electrode current and the cooling fluid is surrounded by a metal tube 11*a*, which is at a spacing therefrom. The metal tube 11*a* is again electrically insulated from the current-carrying cooling system. For this purpose, a flange 12*a* which is welded to the metal tube 11*a* is in turn secured to the lower end of the cylindrical holding portion 2*a*, by way of a spacer ring 13*a* of heat-resistant insulating material. The fixing means used is a screw connection 14*a* and 15*a*, which is similar to the embodiment described hereinbefore. In order to protect the screw connection 14*a* and 15*a*, in this embodiment an annular metal plate 24 is welded or screwed to the outside surface of the metal tube 11*a*.

The refractory substance 17*a* is disposed between the metal tube 11*a* and the tube 18 which carries the electrode current and the cooling fluid, as in the first embodiment.

We claim:

1. A fluid-cooled holder for the tip of an electrode of an electric arc smelting furnace, comprising: a holding portion adapted to be secured to an electrode support arm, a metal cooling system for cooling said electrode and for carrying electrode current, said cooling system being secured to said holding portion and having a free-end carrying a screw-threaded portion for screwing on the electrode tip, an electrically insulating refractory substance surrounding said cooling system, and a metal tube snuggly fitting around said substance and being electrically insulated with respect to said cooling system, said refractory substance being sufficiently thermally conductive so that the temperature of the metal tube is kept to a value below the softening temperature of the material of the metal tube upon insertion of said holder in an electric arc smelting furnace.

2. A fluid-cooled holder according to claim 1, wherein said refractory substance between the metal tube and the metal cooling system is selected such that the temperature of the metal tube upon insertion into the electric arc smelting furnace reaches a value no higher than 600° C.

3. A fluid-cooled holder according to claim 1 wherein said metal tube is made from a soft carbon steel.

4. A fluid-cooled holder according to claim 1, wherein said metal tube is made from non-magnetic metal.

5. A fluid-cooled holder according to claim 1, wherein said metal tube is made from steel with elevated resistance to scaling.

6. A fluid-cooled holder according to claim 1, wherein said refractory substance is a granular refractory material.

7. A fluid-cooled holder according to claim 1, wherein said refractory substance is a tampable refractory material.

8. A fluid-cooled holder according to claim 1, wherein said refractory substance is a cast refractory material.

9. A fluid-cooled holder according to claim 1, wherein the refractory substance is magnesium oxide.

10. A fluid-cooled holder according to claim 1, wherein the refractory substance is aluminium oxide.

11. A fluid-cooled holder according to claim 1, wherein said cooling system comprises at least one pair of metal ducts which carry the screw-threaded portion and which are in communication with each other by means of at least one fluid passage in the screw-threaded portion.

12. A fluid-cooled holder according to claim 1, wherein said cooling system includes an inner tube which is fitted into an outer metal tube and at a spacing therefrom, and wherein the annular space between said inner and outer tubes is in communication with the interior of the inner tube in the region of the electrode holder adjacent said screw threaded portion.

13. A fluid-cooled holder according to claim 12, comprising baffle plates for the cooling fluid arranged in the annular space between said inner and outer tubes.

14. A fluid-cooled holder according to claim 13, wherein said inner tube and said baffle plates form a unitary member which is inserted into the outer tube.

15. A fluid-cooled holder according to any one of claims 12 to 14, wherein said outer tube is circular and said inner tube is square or rectangular, and wherein the annular space between said inner and outer tubes is subdivided into four sector-shaped passages by the outer edges of the inner tube.

16. A fluid-cooled holder according to claim 15, wherein said baffle plates are offset from each other vertically so as to form a meander or zig-zag shaped flow path.

* * * * *